US005695676A

United States Patent [19]

Lee

[11] Patent Number: 5,695,676

[45] Date of Patent: Dec. 9, 1997

[54] MODULAR FORM ASSEMBLY FOR CONCRETE STRUCTURES

[76] Inventor: Wen-Yuan Lee, 7F-3, No. 8, Lane 390, Sec. 1, Chien-Kang Rd., Tainan City, Taiwan

[21] Appl. No.: 552,051

[22] Filed: Nov. 2, 1995

Related U.S. Application Data

[63] Continuation-in-part of Ser. No. 373,853, Jan. 18, 1995, Pat. No. 5,544,852.

[51] Int. Cl.[6] ..... E04G 17/075

[52] U.S. Cl. ..... 249/40; 249/213; 52/426; 52/699

[58] Field of Search ..... 249/38, 40, 213, 249/189; 52/699, 426

[56] References Cited

U.S. PATENT DOCUMENTS

| | | | |
|---|---|---|---|
| 3,360,232 | 12/1967 | Vandenheuvel | 249/213 X |
| 3,550,898 | 12/1970 | Ursini et al. | 249/47 X |
| 3,920,214 | 11/1975 | Lovisa et al. . | |
| 4,901,497 | 2/1990 | Lee | 249/196 X |
| 4,957,272 | 9/1990 | Lee | 249/196 |
| 5,137,250 | 8/1992 | McCracken | 249/40 |
| 5,160,640 | 11/1992 | Badstieber | 249/40 X |

FOREIGN PATENT DOCUMENTS 2297115 7/1996 United Kingdom .

*Primary Examiner*—Robert J. Warden
*Assistant Examiner*—E. Leigh Dawson
*Attorney, Agent, or Firm*—Birch, Stewart, Kolasch & Birch, LLP

[57] ABSTRACT

A modular form assembly includes a plurality of vertical channel pieces coupled detachably side by side to one another. Each of the channel pieces includes two opposing vertical side walls and an intermediate vertical form wall which interconnects the side walls. The side walls of each of the channel pieces abut against and are attached detachably to the side walls of adjacent two of the channel pieces such that the form walls are arranged in a side-to-side contiguity in order to place the form walls in a common vertical plane. Each of the form walls is formed with at least one through-hole therethrough. Each of a plurality of cover plates is mounted removably on one of the form walls to cover a respective one of the through-holes. At least one of the cover plates is formed with at least one positioning hole therethrough.

8 Claims, 7 Drawing Sheets

MODULAR FORM ASSEMBLY FOR CONCRETE STRUCTURES

CROSS-REFERENCE TO RELATED APPLICATION

This application is a continuation-in-part of application Ser. No. 08/373,853 filed on Jan. 18, 1995, now U.S. Pat. No. 5,544,852, the entire contents of which are hereby incorporated by reference.

BACKGROUND OF THE INVENTION

1. Field of the Invention

This invention relates to a form assembly, more particularly to a modular form assembly which has a plurality of vertical channel pieces that can be coupled detachably side by side to one another to constitute a desired dimension of common form plane for forming a concrete structure.

2. Description of the Related Art

Referring to FIGS. 1 and 2, a modular form assembly described in co-pending U.S. patent application Ser. No. 08/373,853 by the applicant is shown to include a plurality of vertical channel pieces 1 which are coupled detachably side by side to one another, and a plurality of horizontal reinforcement units 2 which are connected detachably to one another and which are attached detachably to the vertical channel pieces 1.

Each of the channel pieces 1 includes two opposing vertical side walls 11 and an intermediate vertical form wall 10 which interconnects the side walls 11. The side walls 11 of each channel piece 1 abut against and are attached detachably to the side walls 11 of adjacent two of the channel pieces 1 such that the form walls 10 can be arranged in a side-to-side contiguity in order to place the form walls 10 in a common vertical plane. Each of the channel pieces 1 further includes a pair of elongated blocks 12 secured respectively to two opposite inner sides of the side walls 11 adjacent to the rear end faces of the latter. Each of the reinforcement units 2 is connected detachably to the elongated blocks 12 of the side walls 11 by means of bolt fasteners (not shown) so as to maintain the form walls 10 in their common vertical plane and avoid horizontal bend of the form walls 10 during use.

The channel pieces 1 can be manufactured in different dimensions. For example, the form walls 10 can be made to have widths of 10 cm, 12 cm . . . 20 cm. Accordingly, channel pieces 1 with different dimensions can be applied to construct walls with desired dimensions, such as the narrow walls at the narrow aisles or at the vent passageways. In addition, the side walls 11 of the channel pieces 1 can further function as reinforcing parts to avoid vertical bend of the form walls 10 during use.

When constructing a concrete wall, two common vertical planes are located face to face to form a predetermined space, as shown in FIG. 2, into which concrete is to be poured. The form walls 10 have positioning holes 101 (see FIG. 1) formed therethrough at predetermined positions for alignment with the positioning holes 101 in the opposite form walls 10 in order to mount positioning bars 13 therewithin. Thus, the predetermined space between the opposite common vertical planes can be maintained when concrete is poured thereinto.

Note that the positioning holes 101 in the opposite common vertical planes must be aligned to facilitate securing of the latter by means of the positioning bars 13. Since the positioning holes 101 are usually formed beforehand, misalignment of the positioning holes 101 cannot be entirely avoided when the common vertical planes are installed. Thus, although the modular form assembly is quite easy and convenient to install or dismantle since it includes only two main parts, e.g. the channel pieces 1 and the reinforcement units 2, there may be a need to provide additional positioning holes 101 in the form walls 10 and to fill in the original positioning holes 101. Furthermore, frame units (not shown) for a window or door are usually provided between the common vertical planes prior to pouring of concrete. If the frame units block the positioning holes 101, the positioning bars 13 cannot be installed unless additional positioning holes 101 are formed.

SUMMARY OF THE INVENTION

Therefore, the object of the present invention is to provide a modular form assembly which facilitates the installation of positioning bars so as to overcome the drawbacks described beforehand.

According to the present invention, a modular form assembly includes a plurality of vertical channel pieces coupled detachably side by side to one another. Each of the channel pieces includes two opposing vertical side walls and an intermediate vertical form wall which interconnects the side walls. The side walls of each of the channel pieces abut against and are attached detachably to the side walls of adjacent two of the channel pieces such that the form walls are arranged in a side-to-side contiguity in order to place the form walls in a common vertical plane. Each of the form walls is formed with at least one through-hole therethrough. Each of a plurality of cover plates is mounted removably on one of the form walls to cover a respective one of the through-holes. At least one of the cover plates is formed with at least one positioning hole therethrough.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
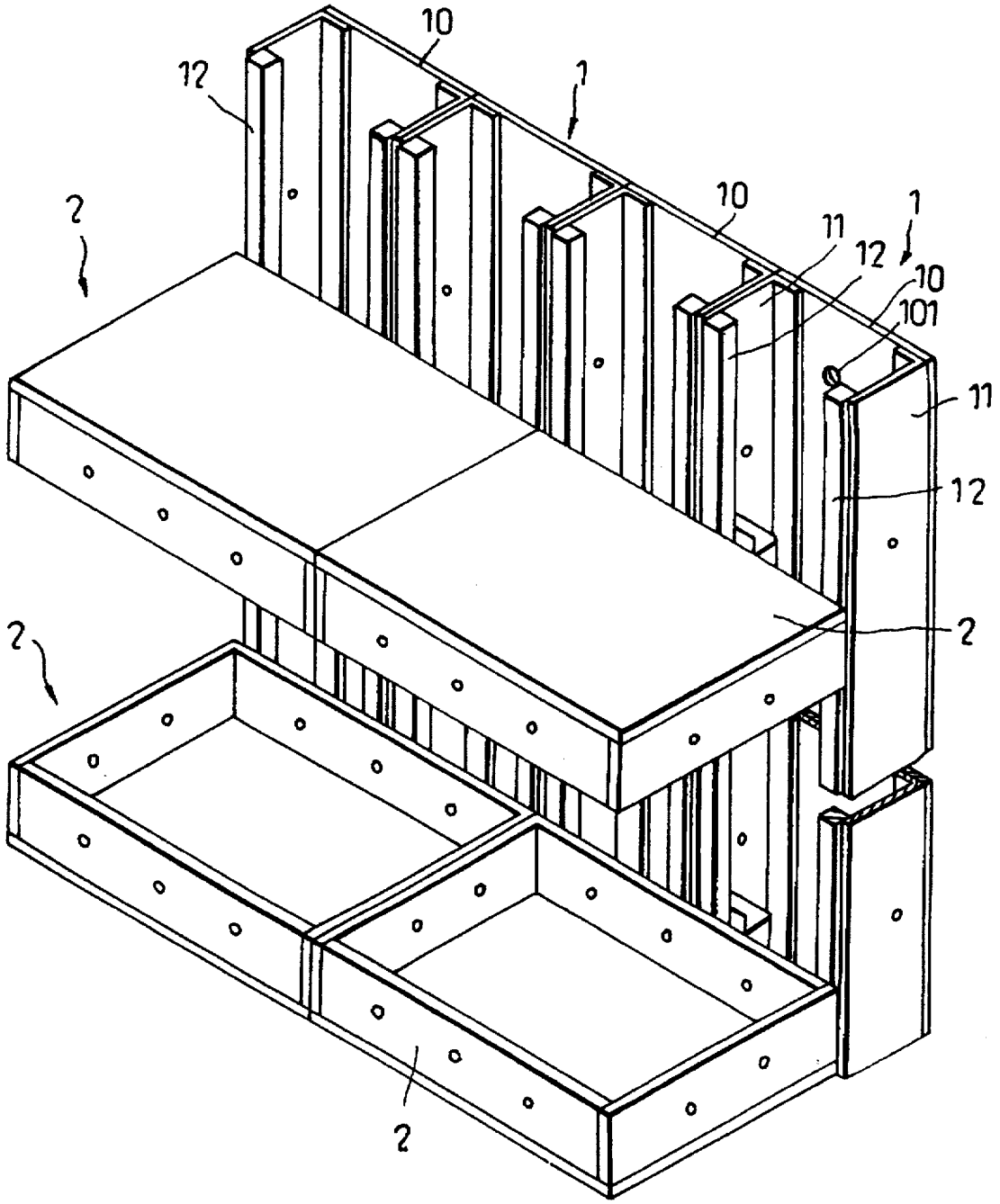
FIG. 1 is a rear perspective view showing a modular form assembly disclosed in co-pending U.S. patent application Ser. No. 08/373,853 by the applicant.
Figure 2:
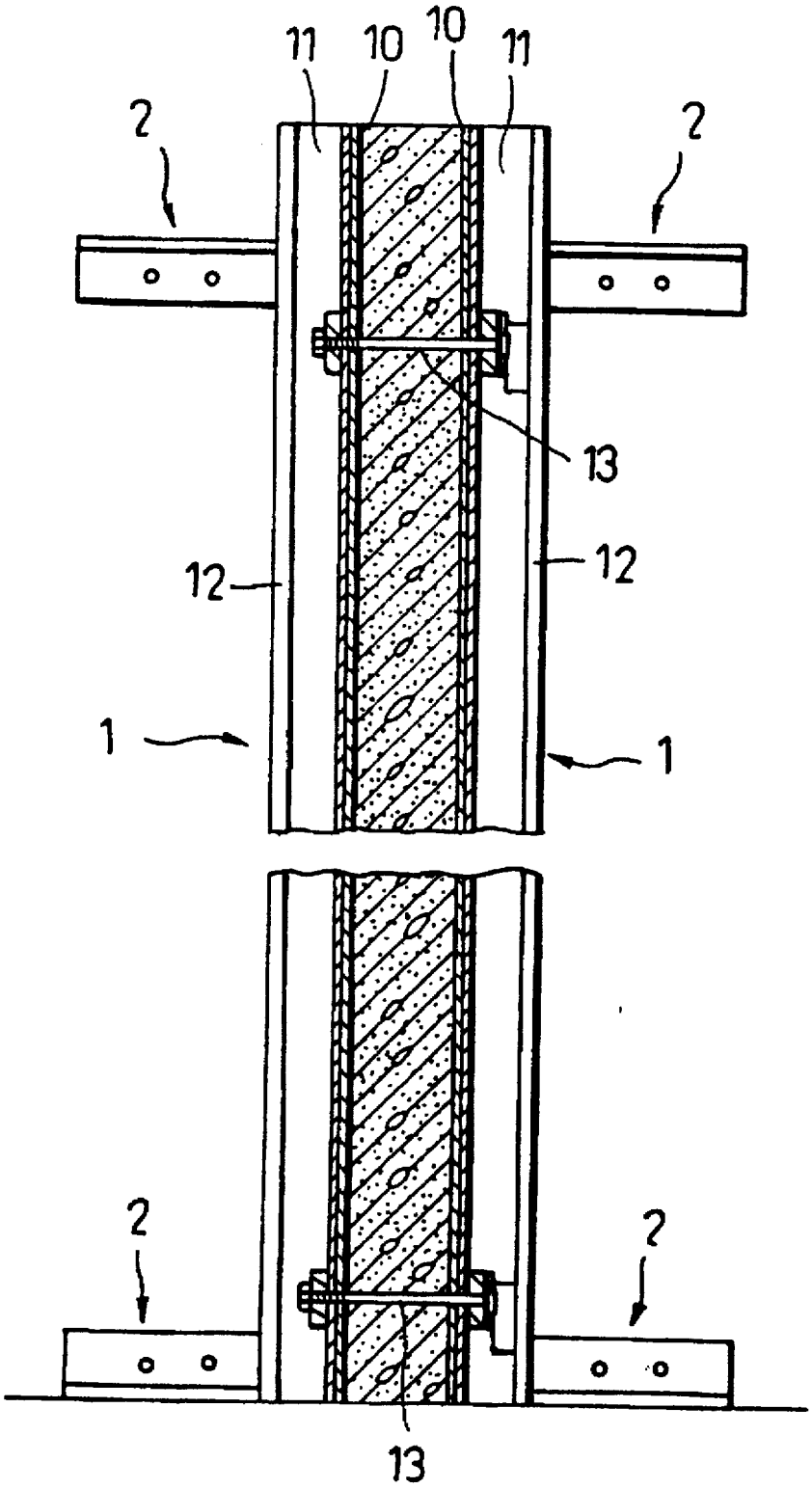
FIG. 2 is a schematic view illustrating how the modular form assembly of FIG. 1 is applied to form a concrete structure.

Before the present invention is described in greater detail, it should be noted that like elements are denoted by the same reference numerals throughout the disclosure.

The improvement of this invention is directed to the modular form assembly disclosed in co-pending U.S. patent application Ser. No. 08/373,853 by the applicant. The entire disclosure of the co-pending U.S. patent application is incorporated herein by reference.

Figure 3:
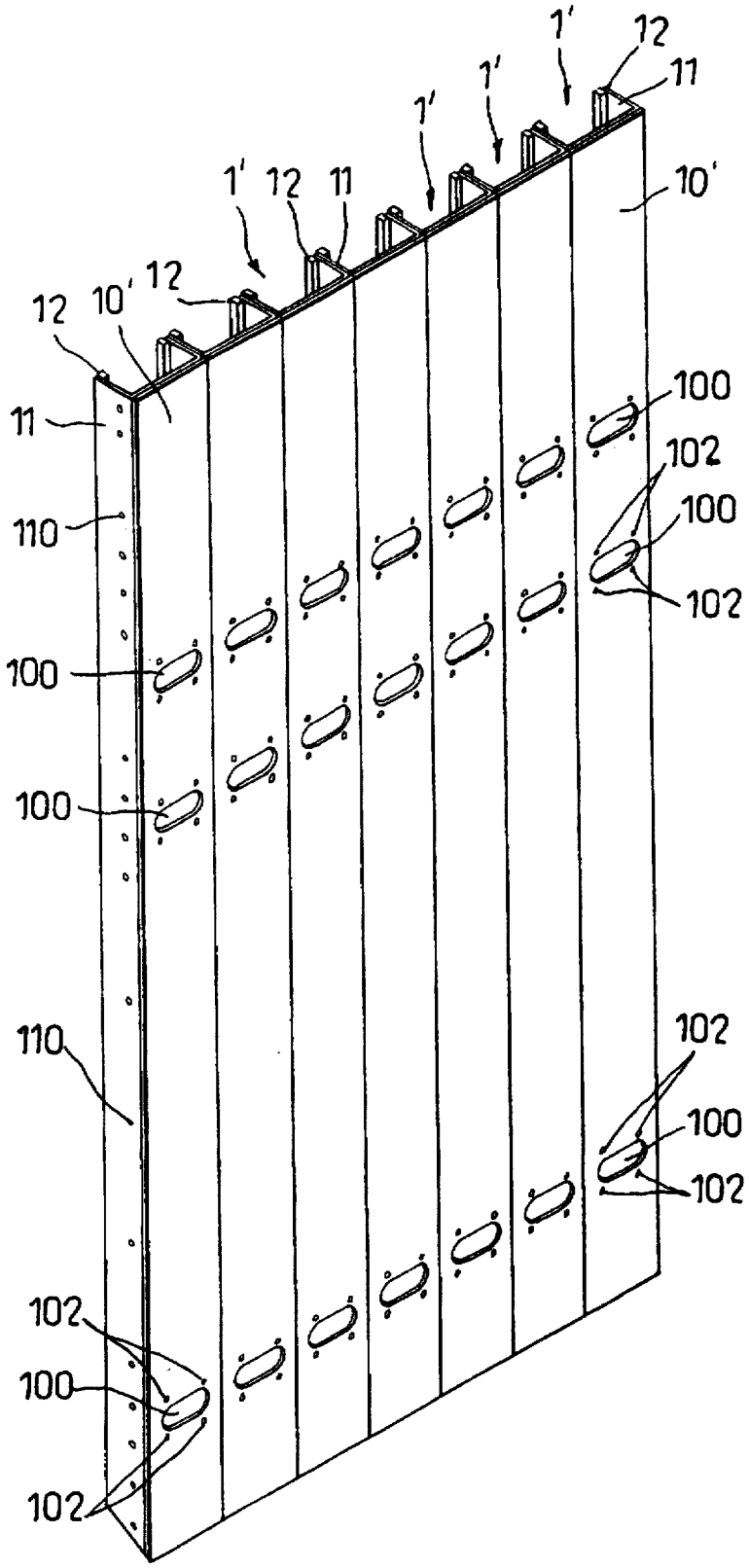
FIG. 3 is a perspective view illustrating vertical channel pieces of a modular form assembly of this invention.

As shown in FIG. 3, the modular form assembly of this invention includes a plurality of vertical channel pieces 1' which are coupled detachably side by side to one another. A plurality of horizontal reinforcement units (not shown) are connected detachably to one another and are attached detachably to the vertical channel pieces 1'.

Each of the channel pieces 1' includes two opposing vertical side walls 11 and an intermediate vertical form wall 10' which interconnects the side walls 11. The side walls 11 of each channel piece 1' abut against and are attached detachably to the side walls 11 of adjacent two of the channel pieces 1' by means of screw fasteners which extend through aligned holes 110 in the side walls 11 so that the form walls 10' can be arranged in a side-to-side contiguity in order to place the form walls 10' in a common vertical plane. Each of the channel pieces 1' further includes a pair of elongated blocks 12 secured respectively to two opposite inner sides of the side walls 11 adjacent to the rear end faces of the latter. The reinforcement units are connected detachably to the elongated blocks 12 so as to maintain the form walls 10' in their common vertical plane and avoid horizontal bend of the form walls 10' during use. The structure of and connection among the reinforcement units, and the connection of the reinforcement units to the channel pieces have been disclosed in the aforementioned co-pending U.S. patent application by the applicant and will not be detailed herein.

The form walls 10' are formed with a predetermined number of through-holes 100 therethrough at predetermined positions. In this embodiment, each of the form walls 10' is formed with three through-holes 100. Two of the through-holes 100 are located on an upper portion of the form wall 10'. The remaining through-hole 100 is formed in a lower portion of the form wall 10'. Preferably, the through-holes 100 are generally oblong-shaped and are longer in a horizontal direction than in a vertical direction. The form wall 10' is further formed with four screw holes 102 around each through-hole 100. Cover plates 3, such as that shown in FIG. 4, are mounted removably on the form wall 10' to cover the through-holes 100, as shown in FIG. 5.

Figure 4:
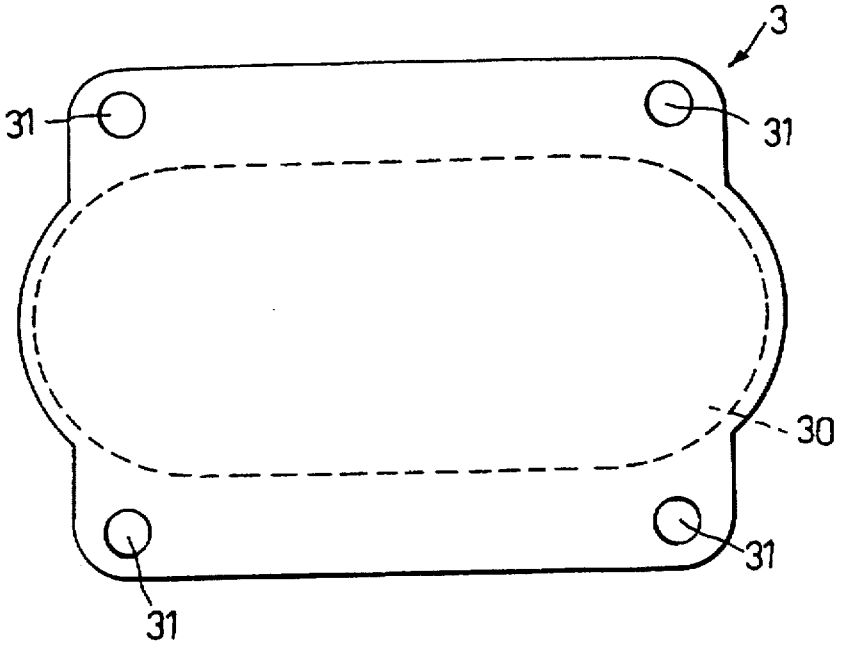
FIG. 4 is a rear view of the first preferred embodiment of a cover plate of the modular form assembly of this invention.
Figure 5:
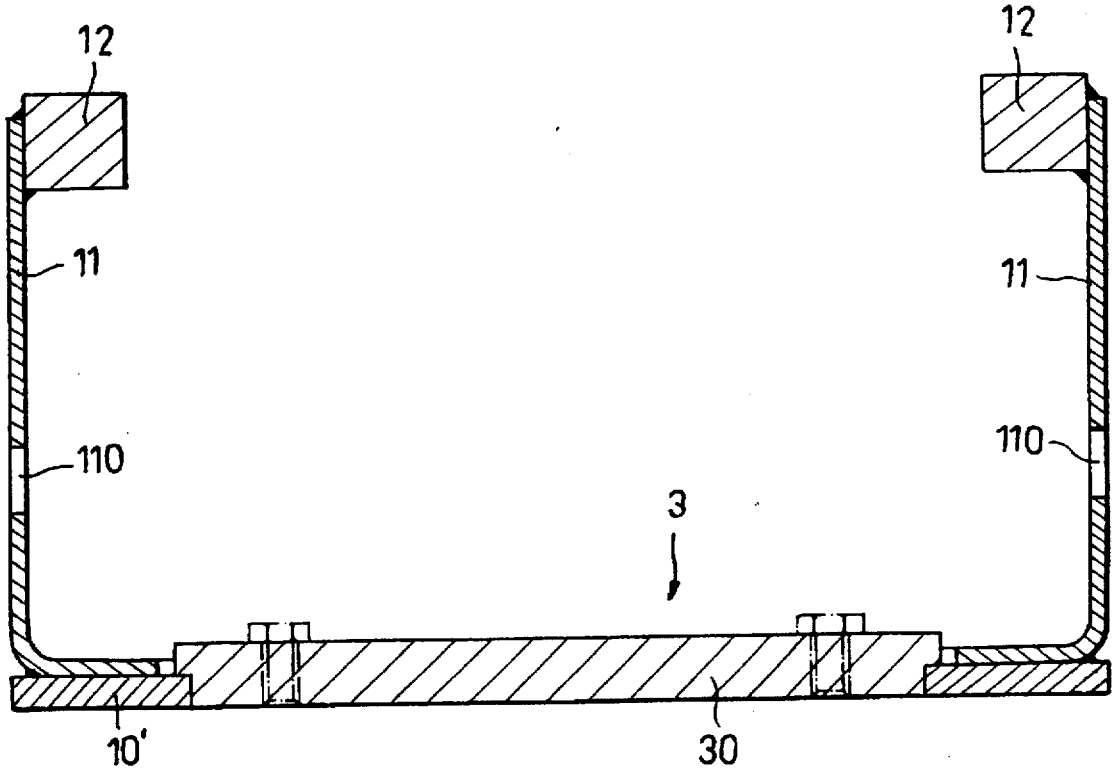
FIG. 5 is a sectional view illustrating how the cover plate of FIG. 4 is installed on one of the vertical channel pieces of FIG. 3.

Referring to FIG. 4, the first preferred embodiment of a cover plate 3 for the modular form assembly of this invention is shown to comprise a rectangular plate body having a screw hole 31 formed on each of the four corners thereof. The screw holes 31 are to be aligned with the screw holes 102 around one of the through-holes 100 of the form wall 10' and permit the passage of screw fasteners (shown in dotted lines in FIG. 5) therethrough for mounting removably the cover plate 3 on the form wall 10'. The cover plate 3 has a front side formed with a forwardly protruding oblong projection 30 which has a size and shape that correspond with those of the through-holes 100 and which has a thickness that is equal to the thickness of the form wall 10'. The projection 30 extends into one of the through-holes 100 so as to fill up completely the latter in order to maintain smoothness at the front side of the form wall 10' as shown in FIG. 5

Figure 6:
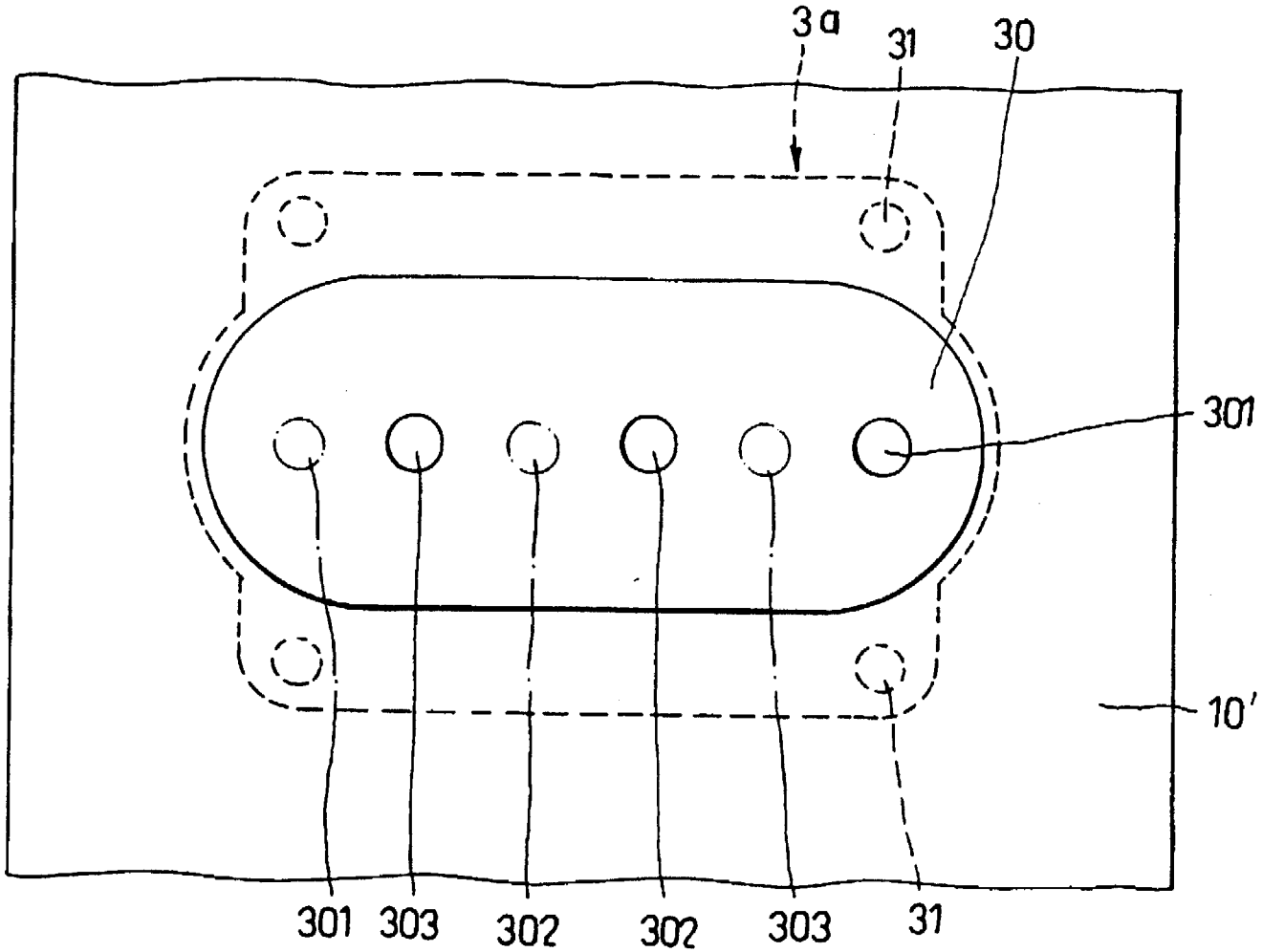
FIG. 6 illustrates the second preferred embodiment of a cover plate according to the present invention.

When the modular form assembly of the present invention is in use, some of the cover plates which are in use are provided with at least one off-center positioning hole. Referring to FIG. 6, one such cover plate 3*a*, which is similar to the cover plate 3 described beforehand, has a horizontally aligned row of three positioning holes 301, 302, 303 that are formed through the oblong projection 30 thereof and that are equally displaced by a predetermined small distance. The positioning hole 301 is located closer to the periphery of the oblong projection 301 than the positioning hole 303. The middle positioning hole 302 is not disposed at the center of the oblong projection 31. Thus, when the cover plate 3*a* is turned 180° before being mounted onto the form wall 10', the new locations of the positioning holes 301, 302, 303, as shown by the phantom lines, differ from the previous locations of the positioning holes 303, 302, 301, respectively. Therefore, even though there are only three positioning holes 301, 302, 303 formed on the cover plate 3*a*, the cover plate 3*a* can provide six different locations for permitting installation of the positioning bars 13 (see FIG. 9) which are used to maintain the predetermined space between opposite common vertical planes when concrete is poured into the predetermined space. In view of the larger number of available positioning holes as compared to the modular form assembly disclosed in co-pending U.S. patent application Ser. No. 08/373,853, alignment of two of the positioning holes in the opposite common vertical planes can be easily attained to minimize the need for providing additional positioning holes in the form walls 10' when the present invention is in use.

Figure 7:
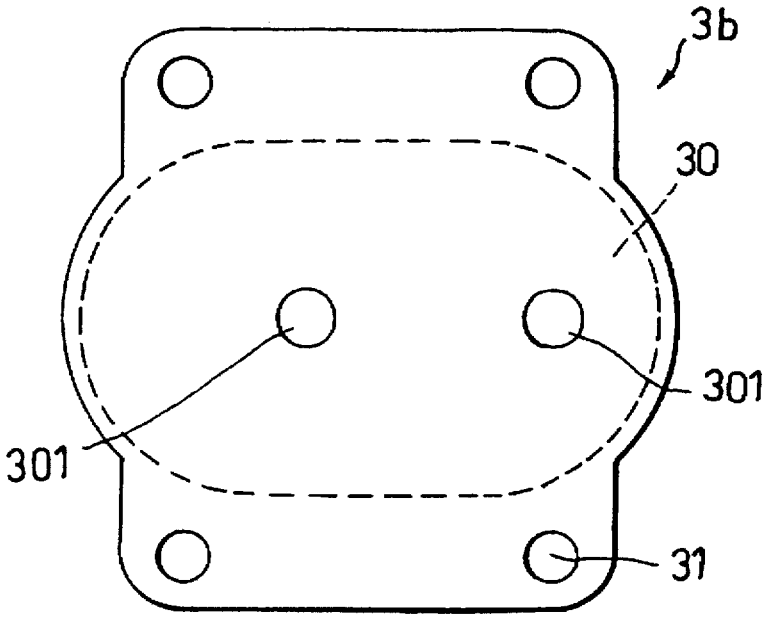
FIG. 7 is a rear view of the third preferred embodiment of a cover plate of the modular form assembly of this invention.
Figure 8:
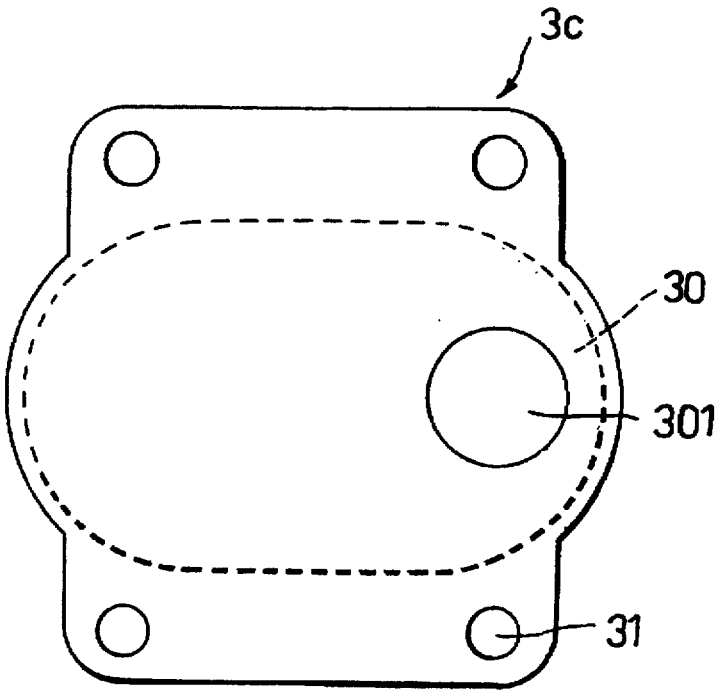
FIG. 8 is a rear view of the fourth preferred embodiment of a cover plate of the modular form assembly of this invention.

Since the form walls 10' can be manufactured in different widths, the sizes of the through-holes 100 may vary accordingly. Thus, it is necessary to provide cover plates which match the through-holes 100 of the narrower form walls 10'. FIG. 7 shows a cover plate 3*b* for use with a narrower form wall 10'. The cover plate 3*b* is shown to comprise a rectangular plate body having a screw hole 31 formed on each of the four corners thereof, and a front side provided with a forwardly protruding oblong projection 30 which has a pair of horizontally aligned off-center positioning holes 301 formed therethrough. FIG. 8 shows another cover plate 3*c* for use with a narrower form wall 10'. The cover plate 3*c* is shown to comprise a rectangular plate body having a screw hole 31 formed on each of the four corners thereof, and a front side provided with a forwardly protruding oblong projection 30 which has an off-center positioning hole 301 formed therethrough. The positioning hole 301 of the cover plate 3*c* is larger than those of the previously described cover plates to suit a thicker positioning bar 13. Since the number, location and size of the positioning holes on the form walls 10' can be varied by simply changing the cover plates, the adaptability of the modular form assembly of the present invention when the latter is in use can be enhanced.

Initially, after the modular form assembly of this invention has been assembled such that the form walls 10' are placed in a common vertical plane, the cover plates 3 are used to close the through-holes 100 on the form walls 10'. Then, at the locations where the positioning bars 13 are to be installed, the cover plates 3 are removed and are replaced by any of the cover plates 3*a*, 3*b*, 3*c* shown in FIGS. 6 to 8.

Figure 9:
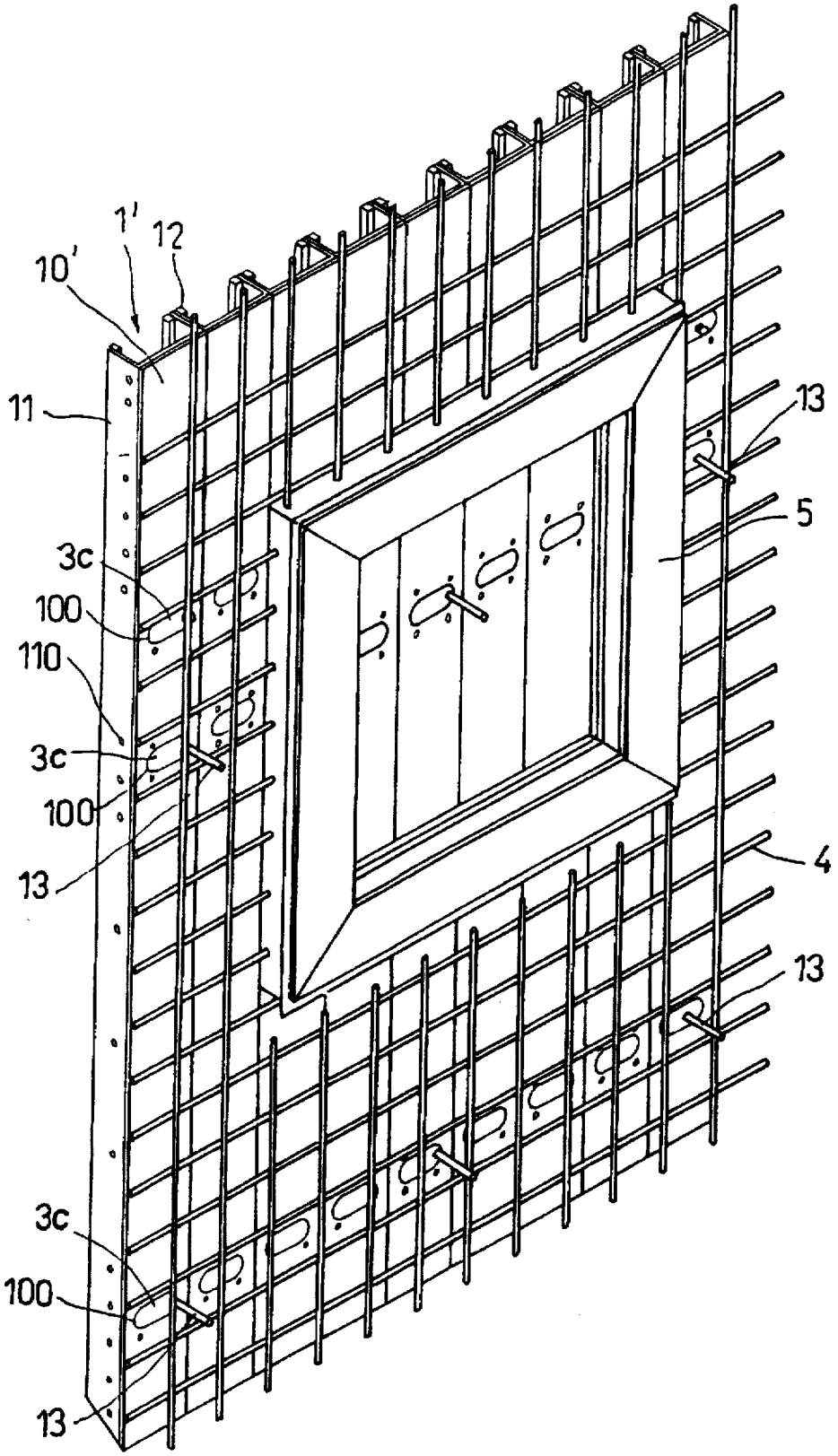
FIG. 9 is a perspective view illustrating how the modular form assembly is applied to form a concrete structure in accordance with this invention.

FIG. 9 illustrates the modular form assembly when applied to form a concrete structure in accordance with this invention. As shown, the channel pieces 1' are coupled detachably side by side to one another in the aforementioned manner, and some of the cover plates 3 have been replaced by the cover plates 3c. A grid of reinforcing bars 4 and a window frame unit 5 are arranged on a front side of the form walls 10' of the channel pieces 1'. When constructing a concrete wall, an opposite modular form assembly (not shown) is installed such that there are two common vertical planes which are located face to face and which form a predetermined space into which concrete is to be poured. The positioning bars 13 are mounted on selected aligned ones of the positioning holes on the common vertical planes to maintain the predetermined space between the opposite common vertical planes when concrete is poured thereinto. Preferably, the positioning holes are threaded internally and the positioning bars 13 are mounted threadedly in the positioning holes. In addition, appropriate ones of the form walls 10' can hold the window frame unit 5 temporarily in place by using screw fasteners which extend through the positioning holes in corresponding ones of the cover plates 3c. In the event that there are some positioning holes which are not in use, these can be blocked with the use of stubs (not shown).

It has thus been shown that other positioning holes are readily available for use in the installation of the positioning bars 13 when the window frame unit 5 or the reinforcing bars 4 block previously selected ones of the positioning holes. Therefore, there is no need to form additional positioning holes in the form walls 10'.

The advantages and characterizing features of the modular form assembly of this invention are as follows:

1. The likelihood that the positioning holes in opposite form walls are misaligned can be minimized to result in added convenience when the modular form assembly of this invention is used to form a concrete structure.

2. There is no need to adjust the positions of the opposite modular form assemblies to align the positioning holes thereon.

3. There is no need to provide the form walls with additional positioning holes when door or wall frame units are to be installed in the concrete pouring space.

4. The number, location and size of the positioning holes can be varied by mere replacement of the cover plates.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A modular form assembly, comprising:

a plurality of vertical channel pieces coupled detachably side by side to one another, each of said channel pieces including two opposing vertical side walls and an intermediate vertical form wall which interconnects said side walls, said side walls of each of said channel pieces abutting against and being attached detachably to said side walls of adjacent two of said channel pieces such that said form walls are arranged in a side-to-side contiguity in order to place said form walls in a common vertical plane, each of said form walls being formed with at least one through-hole therethrough; and a plurality of cover plates, each of said cover plates being mounted removably on one of said form walls to cover a respective one of said through-holes, at least one of said cover plates being formed with at least one positioning hole therethrough wherein each of said cover plates comprises a plate body having a front side formed with a forwardly protruding projection which has a size and shape that correspond with those of said through-holes on said form walls and which has a thickness that is equal to thickness of said form walls, said projection extending into and filling up completely the respective one of said through-holes.

2. The modular form assembly as claimed in claim 1, wherein said plate body has a plurality of screw holes formed along a periphery of said projection to permit passage of screw fasteners therethrough for mounting removably said cover plate on said form wall.

3. The modular form assembly as claimed in claim 2, wherein said positioning hole is formed through said projection and is off-set from a center of a corresponding through-hole of the form walls.

4. The modular form assembly as claimed in claim 3, further comprising a plurality of horizontal reinforcement units interconnected detachably to each other and connected detachably to said side walls opposite to said form walls so as to maintain said form walls in said common vertical plane.

5. The modular form assembly as claimed in claim 1, wherein said positioning hole is formed through said projection and is off-set from a center of a corresponding through-hole of the form walls.

6. The modular form assembly as claimed in claim 5, further comprising a plurality of horizontal reinforcement units interconnected detachably to each other and connected detachably to said side walls opposite to said form walls so as to maintain said form walls in said common vertical plane.

7. A modular form assembly, comprising:

a plurality of vertical channel pieces coupled detachably side by side to one another, each of said channel pieces including two opposing vertical side walls and an intermediate vertical form wall which interconnects said side walls, said side walls of each of said channel pieces abutting against and being attached detachably to said side walls of adjacent two of said channel pieces such that said form walls are arranged in a side-to-side contiguity in order to place said form walls in a common vertical plane, each of said form walls being formed with at least one through-hole therethrough; and a plurality of cover plates, each of said cover plates being mounted removably on one of said form walls to cover a respective one of said through-holes, at least one of said cover plates being formed with at least one positioning hole therethrough wherein said positioning hole is off-set from a center of a corresponding through-hole of the form walls, and said through-hole is larger than said positioning hole.

8. The modular form assembly as claimed in claim 7, further comprising a plurality of horizontal reinforcement units interconnected detachably to each other and connected detachably to said side walls opposite to said form walls so as to maintain said form walls in said common vertical plane.

* * * * *